US005803705A

United States Patent [19]

Keyes

[11] Patent Number: 5,803,705

[45] Date of Patent: Sep. 8, 1998

[54] DISK TYPE INVERTER-STACKER WITH IMPROVED SHEET HANDLING SLOTS FOR DIFFERENT PAPER WEIGHTS

[75] Inventor: Thomas C. Keyes, Fairport, N.Y.

[73] Assignee: Xerox Corporation, Stamford, Conn.

[21] Appl. No.: 832,251

[22] Filed: Apr. 3, 1997

[51] Int. Cl.[6] ..... B65H 29/20

[52] U.S. Cl. ..... 414/793.9; 414/794; 271/187; 271/315

[58] Field of Search ..... 414/793.9, 794; 271/187, 315

[56] References Cited

U.S. PATENT DOCUMENTS

| | | | |
|---|---|---|---|
| 4,915,371 | 4/1990 | Quinton | 271/315 |
| 5,125,645 | 6/1992 | Eberle | 271/315 |
| 5,180,160 | 1/1993 | Belanger et al. | 271/187 |
| 5,409,201 | 4/1995 | Kramer | 270/53 |
| 5,476,256 | 12/1995 | Fortuna et al. | 271/187 |
| 5,647,586 | 7/1997 | Novick et al. | 271/315 |
| 5,692,740 | 12/1997 | Holtje | 271/315 |

FOREIGN PATENT DOCUMENTS

| | | | |
|---|---|---|---|
| 37039 | 2/1988 | Japan | 271/187 |

*Primary Examiner*—Karen M. Young
*Assistant Examiner*—Doulgas Hess

[57] ABSTRACT

In a disk type sheet inverting and stacking system with rotatable disk units with sheet transporting slots, in which printed sheets outputted by a reproduction system are sequentially fed into those slots to be inverted by rotation of the disk units and then released from the slots at a stacking position, the sheet transporting slots of the disk units are provided with a convolute sheet path formed by plural internal sheet corrugating protuberances extending transversely across the slot from opposite sides of the slot, spaced along the slot, to form a convolute sheet corrugating sheet path within the slot to automatically increase the retention force of the sheet within the slot in proportion to an increase in the thickness or stiffness of the sheet, without substantially increasing the resistance to lateral movement of the sheet within the slot. These protuberances have smoothly arcuate large diameter surfaces, with small surface angles in the direction of sheet insertion, to provide relatively low resistance to the insertion of a sheet into the slots.

1 Claim, 4 Drawing Sheets

DISK TYPE INVERTER-STACKER WITH IMPROVED SHEET HANDLING SLOTS FOR DIFFERENT PAPER WEIGHTS

Disclosed in the embodiments herein is an improved disk type inverter-stacker with improved control of the sheets being inverted and stacked, having specially corrugated sheet carrying slots of the disk units providing improved control therein, yet release of the sheets in the stacking area, by automatically adjusting the sheet retention in the slots in accordance with the paper basis weight and/or stiffness of the sheet.

This disclosed system can prevent inadvertent sheet slippage, sheet skewing or the like as the sheets are being inverted in the rotating disks stacker unit, yet still allow low force automatic stripping of the sheets from the slots at their registration position for stacking. As the weight and/or stiffness of the sheets being fed into and inverted by the feeding slots increases, the sheet retention force holding the sheet in the slots also automatically increases with the disclosed system. This may be accomplished, as shown in the disclosed embodiments, by transverse sheet corrugating ribs or protrusions extending transversely within the sheet transporting slot to corrugate or convolute a sheet therein. These ribs or protrusions are designed to automatically increase the retention of the sheet within the sheet transporting slot in proportion to the stiffness of the sheet. That is, in proportion to the increase in resistance to corrugation (beam strength) of the sheet, which normally correlates to an increase in the weight and/or stiffness of the sheets being fed. It is such heavier and/or stiffer sheets that are more difficult to retain in the disk slots, and the disclosed system provides automatic compensation for that by automatically increasing the retention force for those heavier and/or stiffer sheets.

Although not limited thereto, the improved sheet slots retention system disclosed herein is particularly suitable for use with, and as an improvement in, the slots in the repositionable disk fingers disclosed in commonly /assigned pending U.S. application Ser. No. 08/735,930 , now U.S. Pat. No. 5692,740 issued Dec. 2, 1997 filed Oct. 23, 1996, as docket no. D/96477, by Bruce E. Holtje.

A disclosed feature in the embodiments herein is an improved gripping of the sheet within the sheet transporting slot defined by the disk or disks, which is also understood from the above to include disk fingers, to better hold a sheet within the slot, without slippage, regardless of variations in sheet thickness and/or stiffness.

This is an improvement over prior systems relying on sheet holding springs to hold sheets within smoothly arcuate slots. Examples of such sheet retention springs are shown in the above-cited patent application and other disk stacking system patents cited therein, below, and elsewhere.

Additionally, the subject system of improved retention of the sheet within the disk slot (especially, as the sheet is being inverted, and before it is released) is fully compatible with, and does not interfere with, the necessary subsequent removal of the sheet from that slot onto the sheet output stack. Also, while the disclosed system is increasing the resistance to inadvertent movement of stiff sheets out of the slots, it still allows optional lateral tamping, for side registration, of the same sheet while that sheet is still retained in the disk slots. Such lateral sheet tamping systems, such as elements 40 et al in the below-cited U.S. Pat. No. 5,409,201, are fully described therein and elsewhere and need not be redescribed herein. The disclosed system is compatible with such lateral edge tamping, or the like, by having an increased resistance to the inadvertent pulling of a sheet out of the slot without a substantial increase in resistance to lateral movement of the sheet within the slot.

The disclosed embodiments are also fully compatible with, or may be incorporated with, on-line or subsequent stapling or other finishing of sets of sheets stacked for compiling with the above and other advantages. For example, the variable position stapling and registration system of copending U.S. application Ser. No. 08/689,616, filed Aug. 12, 1996 by Joseph J. Ferrara, et al entitled "Variable Sheet Sets Stapling and Registration Positions System" (D/96336), or set finishers of other patents cited below, such as U.S. Pat. No. 5,409,201, etc.. Various other additional features may be incorporated with the present embodiments.

By way of more general background, in reproduction apparatus such as xerographic and other copiers and printers or multifunction machines, it is increasingly important to provide faster yet more reliable and more automatic handling of the physical image bearing sheets. It is desirable to reliably feed and accurately register sheets of a variety and/or mixture of sizes, types, weights, materials, humidity, and other conditions, or susceptibility to damage. Sheet misregistration or misfeeding can also adversely affect further feeding, ejection, stacking and/or finishing.

Further by way of background as to the disclosed embodiments, the disclosed embodiments can be considered in several respects as improvements over the integral disk type inverter-stacker and stapler system with a bail system of Xerox Corp. U.S. Pat. No. 5,409,201 issued Apr. 25, 1995 to William E. Kramer, but sharing many of the features and advantages of the latter as well. Other examples of disk stacker systems with registration assistance devices include Xerox Corp. U.S. Pat. No. 5,058,880 issued Oct. 22,1991 to T. C. McGraw, et al; and U.S. Pat. No. 5,114,135 issued May 19, 1992 to D. D. Evangelista, et al. Another example of a disk stacker patent, with a discussion of difficulties in stacking flimsy sheets, especially the trailing ends thereof, is Xerox Corp. U.S. Pat. No. 5,261,655 issued Nov. 16, 1993 to Paul D. Keller, et al. That system calls for corrugation of the trailing areas of the sheets while they are in the disk with intermittently interdigitating rollers, and a stacking assistance belt. Various of the above references, and other references cited therein, may be referred to for further details which need not be redescribed herein.

A specific feature of the specific embodiments disclosed herein is to provide, in a disk type sheet inverting and stacking system, for stacking sheets inverted in a stacking position, with rotatable disk units with sheet transporting slots, in which printed sheets outputted by a reproduction system are sequentially fed into said sheet transporting slots of said disk units to be transported therein and inverted by rotation of said disk units and then released from said sheet slots of said disk units at said stacking position; the improvement wherein said sheet transporting slots of said disk units have a convolute sheet path formed by at least one internal transverse sheet corrugating protuberance extending transversely within said sheet transporting slots to corrugate a sheet within a said sheet transporting slot to automatically increase the retention of said sheet within said sheet transporting slot in correlation to an increase in resistance to corrugation of said sheet.

Further specific features disclosed herein, individually or in combination, include those wherein said plural internal transverse sheet corrugating protuberances increase said retention of said sheet within said sheet transporting slot without substantially increasing the resistance to lateral movement of said sheet within said sheet transporting slot; and/or wherein respective said plural internal transverse sheet corrugating protuberances extend from opposing sides of said sheet transporting slot; and/or wherein respective said plural internal transverse sheet corrugating protuberances are spaced along said sheet transporting slot and extend transversely past one another from opposing sides of said sheet transporting slot to form a convolute sheet corrugating path within said sheet transporting slot; and/or wherein at least one of said internal transverse sheet corrugating protuberances extends out transversely from a first side of said sheet transporting slot towards the opposing side of said slot, and at least one other of said plural internal transverse sheet corrugating protuberances extends out from said opposing side of said slot towards said first side of said slot, to form therebetween a convolute sheet corrugating path within said sheet transporting slot; and/or wherein said protuberances have smoothly arcuate large diameter surfaces, with small surface angles in the direction of sheet insertion, to provide relatively low resistance to the insertion of a sheet into said sheet transporting slots.

In the description herein the term "sheet" refers to a usually flimsy physical sheet of paper, plastic, or other suitable physical substrate for images, whether a precut sheet or initially web fed and then cut. A "copy sheet" may document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described herein.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

FIGS. 2A and 2B are enlarged frontal views of slotted disk fingers per se, in which FIG. 2B is the disk finger embodiment of FIG. 1, and FIG. 2A is a somewhat different embodiment, with three interdigitated corrugating ribs within the disk slot instead of two;

Figure 1:
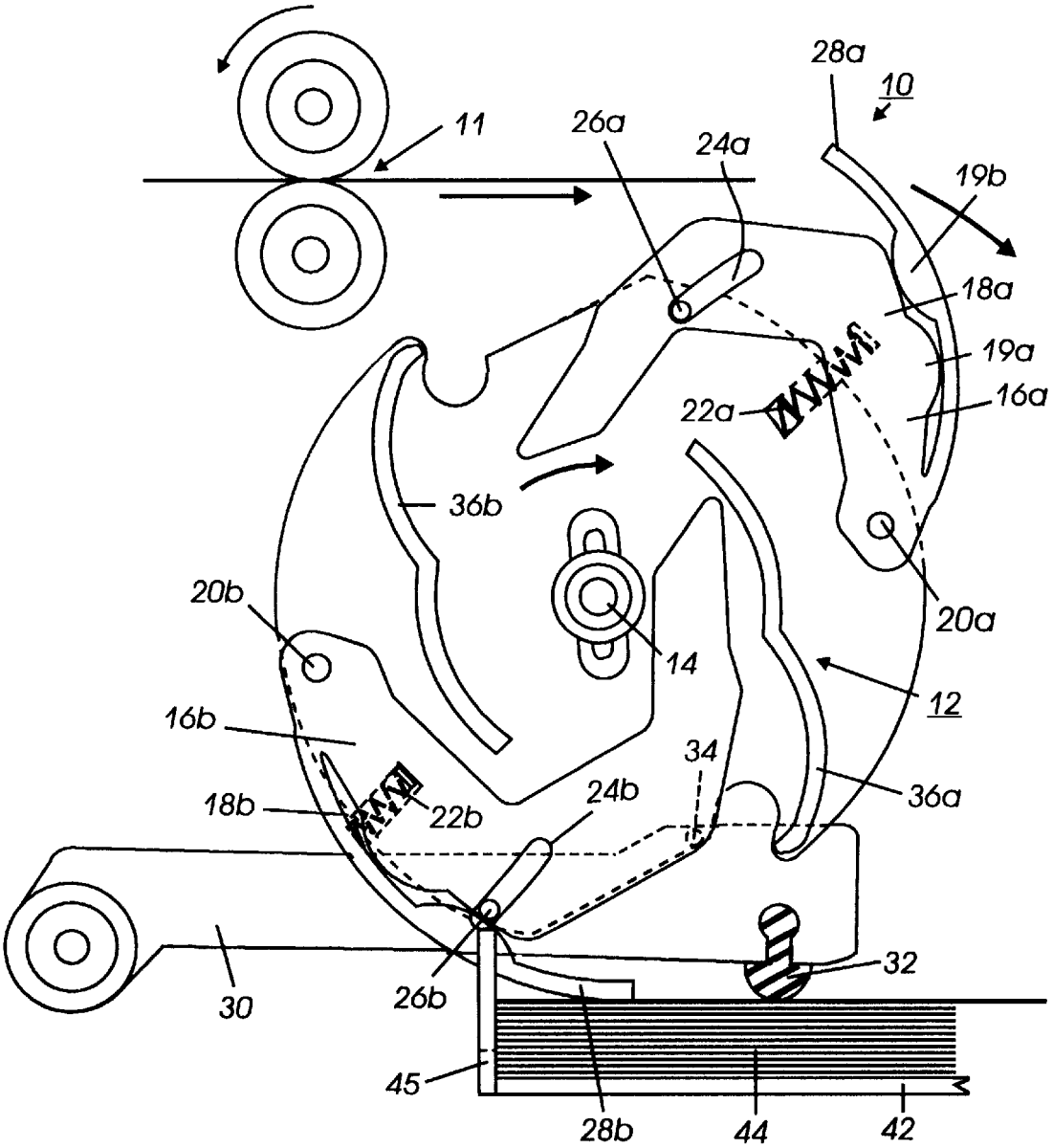
FIG. 1 is a partially schematic front plan view of one exemplary embodiment of an exemplary disk type output inverter-stacker system, otherwise similar to that of the above cited application, but with disk slots modified in accordance with one example (of 2B) of the present disclosure.
Figure 2B:
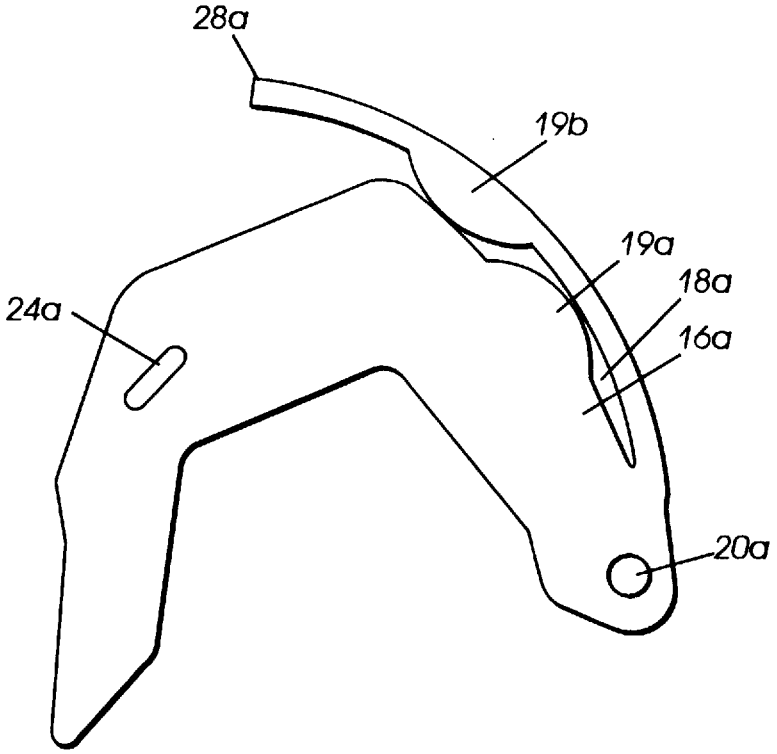
Figure 3:
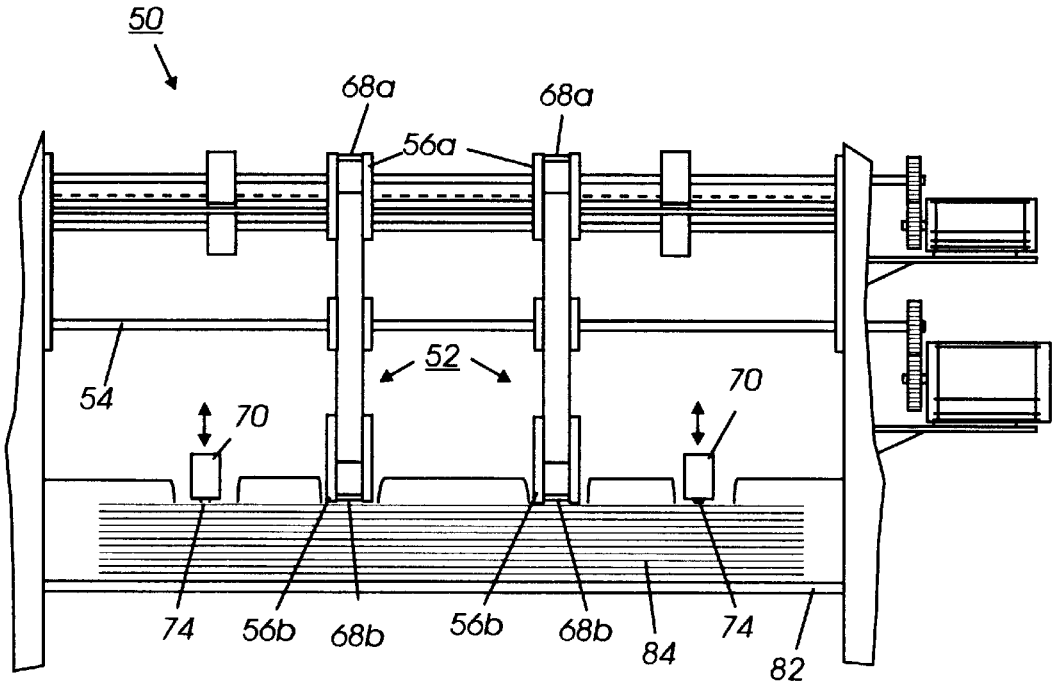
FIG. 3 is a partially schematic side or end view of an embodiment like that of FIG. 1, somewhat simplified by removing drawings of certain components not relevant to the present invention.
Figure 4:
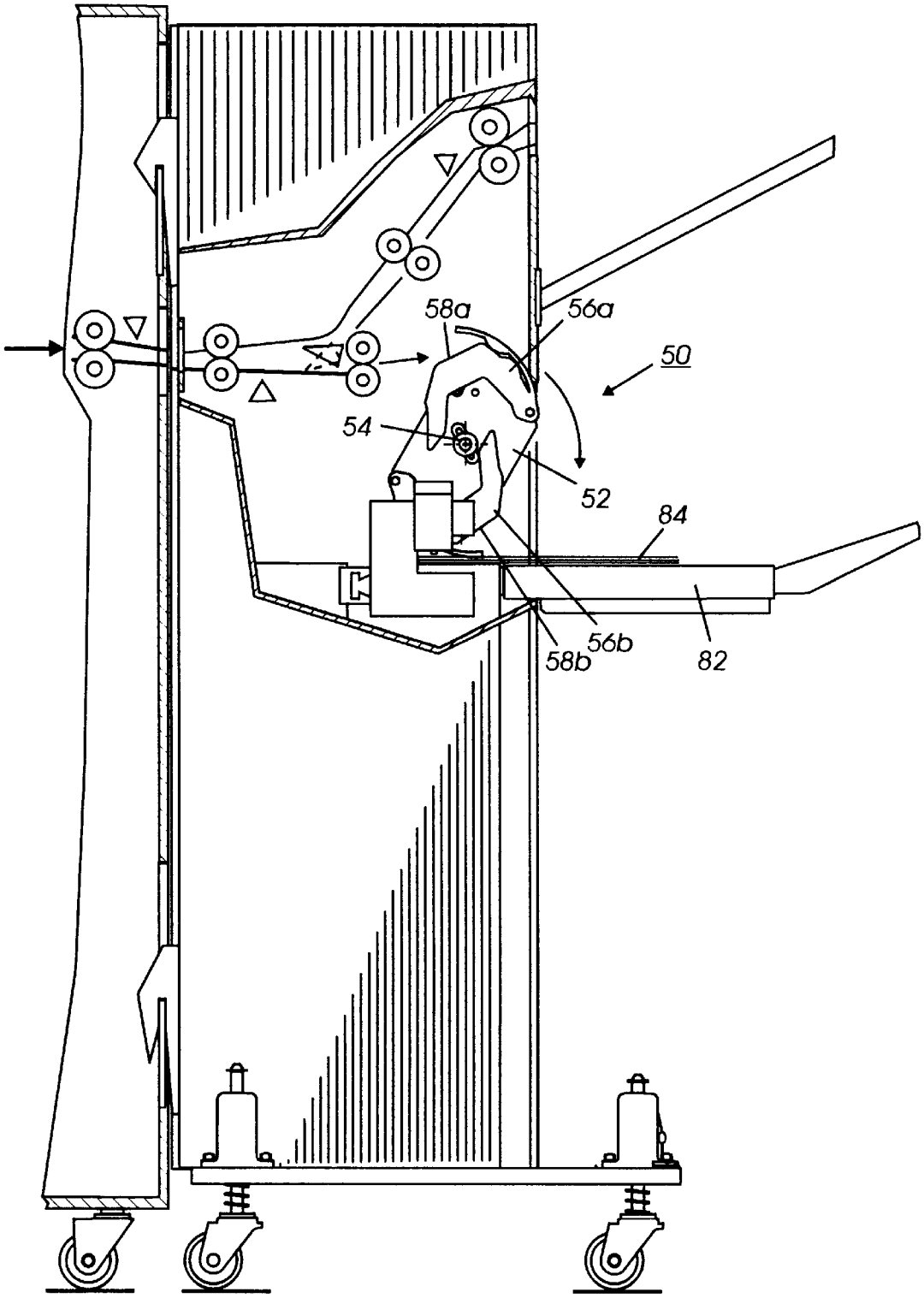
FIG. 4 shows the embodiment of FIG. 3 in an exemplary output stacking and finishing module mounted to the output end of an exemplary printer.

Referring to the Figures, there is shown in FIGS. 1 and 4 from the front of the system (therefore from the side of the paper path or process direction), and in FIG. 3 from the output end of the system, otherwise identical output inverter-stacker systems 10 and 50, respectively, comprising a plurality of disk units 12 or 52, of which the outboard disk is visible in FIGS. 1 and 4. A shaft 14 or 54 mounts and rotates these disk units 12 or 52 to invert, and then stack at 44 or 84, the sequential sheets output of an associated copier or printer for which the system 10 or 50 is an integral or modular output accessory, as is illustrated in FIG. 4. Here, each disk unit 12 or 52 has two pivotal finger units 16*a*, 16*b* or 56*a*, 56*b* respectively independently oppositely mounted thereto at pivotal axes 20*a*, 20*b* or 60*a*, 60*b* on each side of the disk unit 12 or 52, to be described herein in more detail. However, it is also possible to have a different disk unit with only one such finger unit, or with no such fingers and with slots directly in the disks, as shown in the prior art. The finger unit 16*a* of FIGS. 1 and 2B has a sheet transporting slot 18*a*, and the other finger unit 16*b* of FIG. 1 has a similar slot 18*b*. The similar disk finger units 56*a* and 56*b* of FIGS. 3 and 4 have corresponding integral slots 58*a* and 58*b*.

Figure 2A:
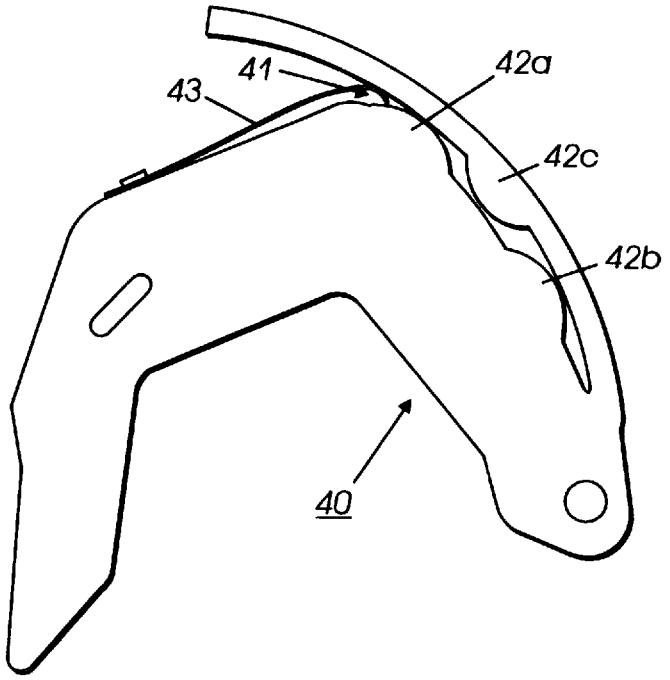

FIG. 2A and FIG. 2B each respectively show one finger unit per se. They represent somewhat different embodiments of the subject sheet corrugating finger slots, as may be seen. The finger unit 16*a* of FIG. 2B is also shown in FIG. 1 and is otherwise similar to finger unit 16*b* of FIG. 1 and to the finger units 56*a* and 56*b* of the other Figures. Spaced along sheet slot 18*a* and internally projecting transversely across slot 18*a* are integral molded in sheet corrugating ribs or protrusions: 19*a* extending radially outward from the inner side of slot 18*a*, and 19*b* extending inwardly from the other (opposing, outward) side of slot 18*a*, but positioned further up in slot 18*a* so as to be offset from protuberance 19*a* in the direction of sheet movement into the slot. Protrusion 19*a* extends past or overlaps in its transverse extension into the slot with 19*b*, and each of the protuberances 19*a* and 19*b* extend almost fully across the slot 18*a*. Thus, as a sheet is inserted down into slot 18*a*, as shown being initiated in FIG. 1, the sheet must sequentially pass around both, and be oppositely corrugated by both, of the protuberances 19*a* and 19*b*.

The alternative finger unit 40 of FIG. 2A is similar to finger unit 16*a* of FIG. 2B, but is presently preferred since it provides more corrugation, and thus more sheet control and sheet thickness or stiffness latitude. The interior surface of the sheet retaining slot 41 of the finger unit 40 has two internal outwardly projecting smoothly arcuate ribs or protrusions 42*a* and 42*b*. In between these two protrusions 42*a* and 42*b* (along the paper path of slot 41) there is projecting inwardly from the other side of the slot 41 an oppositely, internally, projecting rib or protrusion 42*c*. This provides three spaced and alternating sheet corrugation surfaces at 42*a*, 42*b* and 40*c* along the slot 41.

However, the descriptions here with regard to one embodiment of the subject corrugating disk finger slots are otherwise generally applicable to the other. In both cases at least one of the internal transverse sheet corrugating protuberances extends out transversely from a first side of the sheet transporting slot towards, and closely adjacent to, the opposing side of the slot, and at least one other of said plural internal transverse sheet corrugating protuberances extends out from the opposite side of the slot towards the first side of the slot, to provide opposingly laterally projecting protuberances, which forms a highly convolute sheet corrugating path within the sheet transporting slot. This substantially increases the frictional and other retaining forces on the sheet in the slot. These protuberances are smoothly arcuate large diameter surfaces, with small or low sheet edge impacting surface angles in the direction of sheet insertion, so as not to greatly increase the force needed to insert a sheet into the slot.

It has also been found that prior art slot entrance springs such as those previously used to help retain sheets in the slots, as shown in the above-cited patents, can be, if desired, combined with the slot corrugations as disclosed herein or variations thereof, for increased sheet latitude. That is, the optional addition of a low-force sheet slot retaining spring, such as the exemplary thin leaf spring 43 illustrated in FIG. 2A, or other spring, can provide additional control over, by an increase in the retaining force on, thinner sheets in the slots, for insuring that they can be retained in the slots. This can be used in lieu of, or to avoid, using excessive slot corrugations to hold such thinner sheets, since excessive slot corrugations can provide an excessive sheet retention force for much thicker or stiffer sheets, since such thicker sheets must also stripped from the slots by the registration wall or fingers 45 without excessive force, so as to avoid buckling or improper sheet stacking of such sheets.

Referring now first to FIG. 1 for a brief description of an example of the operation of an exemplary disk type inverter/stacker unit such as 10 or 50 here, each disk finger unit such as 16*a* here defines one sheet slot such as 18*a* into which an incoming sheets are fed by an input roller nip 11 (in the unit 10 itself or in the output of the associated reproduction apparatus) or other sheet feeder, which can be of almost any known type and therefore need not be described herein. The disk units 12 may be either stationary or moving when an incoming sheet is fed into the then-uppermost sheet slot at that particular rotational position of the disk units 12. Here, that is the sheet slot 18*a*.

In the present embodiments, as the sheets are fed into the uppermost sheet slot, the sheet is engaged by, but is fed past, the sheet entrance corrugating protuberances such as 19*b* and 19*a* of FIG. 2B, or 42*a*, 42*b* and 42*c* of FIG. 2A. The sheet is not obstructed from entering the sheet slots by these protuberances, and keeps moving down into the slot until the lead edge of the sheet engages the inner or bottom end of the slot, as described in above-referenced patents. These protuberances are smoothly arcuate, and preferably extend transversely of the slots, and project into the slots from one side of the slot almost to the other side of the slot, as shown, to corrugate the sheet in the slot. The protuberances, together with the other sheet confining surfaces of the slot, cause the corrugated sheet to maintain, with increased sheet beam strength, a pressure against the slot walls to help hold the sheet from coming out of the slot as the disks rotate, that is, to provide an increased force engaging the sheet in the slots. That sheet retention force is variable, that is, it is automatically adjusted in proportion to the sheet beam strength, which is a function of the sheet thickness.

As described in the above-cited D/96477, the pivotal fingers 16*a* and 16*b* in FIG. 1, and thus their slots 18*a* or 18*b*, are normally held out to their maximum radius from the central shaft 14 by finger opening springs 22*a* and 22*b*. This is a light spring force, so that the finger 16*a* or 16*b* can be easily pivotally moved inwardly with low force toward the disk unit to reduce the overall radius. The maximum outward or radial movement of these finger units, and therefore the loading position of the sheet slots 18*a*, 18*b*, is controlled in this example by finger opening limiter slots 24*a*, 24*b* in which a finger opening limiter pin 26*a*, 26*b* on the disk unit 12 slides and serves as a stop.

As the disk unit 12 rotates, carrying and inverting the next sheet to be stacked on stack 44 in the output tray 42, the larger radius downstream end 28*a* or 28*b* of the finger units 16*a* or 16*b*, in which the outer end of the sheet slot 18*a* or 18*b* is located, may conventionally pass through a cutout or notch in the registration wall 45, which, as described in the prior art, causes that registration wall or fingers to engage the lead edge of that sheet and stop its forward movement, so that the continued rotation of the disk units 12 strips that sheet out of the slot 18*a* or 18*b* with the lead edge of the sheet retained against the registration wall 45. This defines the sheet stacking area.

Somewhat prior to, and/or at the subsequent point in the rotation of disk unit 12 at which the lead edge area of the sheet is actually fully released out from the control of the sheet slot 18*a* or 18*b*, the outer end surface 28*a* or 28*b* of the sheet unloading finger here will be directly engaging the top of the stack 44. Thus, prior to and during sheet unloading or release, the sheet is effectively separated from the top of the stack by only the very thin thickness of the outer wall of the finger outer end surface 28*a*, 28*b*. This finger tip can be as thin as 1 or 2 mm.

This direct engagement of the finger tip outer end surface 28*a* or 28*b* with the top of the output stack 44 adjacent the registration wall 45 shortly before the end of sheet stripping from the finger slot is enabled by the pivotal mounting of the fingers 16*a*, 16*b*. This allows each finger to automatically adjust to the actual stack height during the stripping operation. It also allows the finger position to adjust to compensate for spacing differences between respective disk units 12, manufacturing tolerances, unevenness or movement errors in the stack elevator control of the output tray 42, and sheet curling, staples, or other unevenness in the sheet stack 44.

As taught in the above-cited U.S. Pat. No. 5,509,201, it is also desirable to coordinate the release of the incoming sheet to be stacked with the lowering thereon of a bail such as 30, preferably with a high friction rubber or other bail tip 32 to engage with normal force and help hold the sheet in its proper registration position. Here in this FIG. 1 embodiment, the lifting of the bail 30 up out of the incoming sheet path and its subsequent release to drop onto that sheet at the appropriate time is controlled by a cam track 36*a* or 36*b*, which here is molded into the side of disk unit 12 in a position to engage and lift a bail pin 34 on the bail 30 by pin 34 riding up on top of the respective cam track to the end of that cam track as the disk unit rotates, whereupon the bail is released to drop onto the sheet being stripped.

Turning now again to the alternative embodiment 50 of FIGS. 3 and 4, most of the above description applies thereto, with some differences which will be described hereinbelow. The finger opening springs provide the same function in outwardly urging these finger units 56*a*, 56*b* to pivot outwardly about the axes 60*a*, 60*b* to the maximum radial extension of their outer ends 68*a*, 68*b* allowed by their finger opening limits or stops. The bails 70 in this system 50 may be more like that shown and described in said U.S. Pat. No. 5,409,201. The bail 70 and its bail tips 74 operate, however, in a similar manner to that described hereinabove, as well as that patent. That is, with coordinated engagement of the stacking sheet being pushed out of the slot by the registration wall by the bail tips 74 closely above the top of the stack 84, irrespective of the stack 84 height or the underlying tray 82 position, due to the automatic compensation of the sheet release height by the pivotal adjustment movement of the finger units 56*a*, 56*b*, allowed by their pivotal mounting.

The finger units are described above in this example as separate but pivotally mounted parts. However, with appropriate suitable plastic materials and moldings they may be integrally molded as part of the disk unit, with sufficiently flexible cantilever connecting webs to the rest of the disk, yet have sufficient stiffness internally to provide suitable sheet carrying slots and ribs.

While the embodiments disclosed herein are preferred, it will be appreciated from this teaching that various alternatives, modifications, variations or improvements therein may be made by those skilled in the art, which are intended to be encompassed by the following claims:

I claim:

1. In a disk type sheet inverting and stacking system, for stacking sheets inverted in a stacking position, with rotatable disk units with narrow sheet transporting slots, in which a single printed sheet outputted by a reproduction system is sequentially fed into a single said sheet transporting slot of said disk units to be transported therein and inverted by rotation of said disk units and then released from said sheet slot of said disk units at said stacking position; the improvement wherein:

said narrow sheet transporting slots of said disk units have a convolute sheet path formed by plural internal transverse sheet corrugating protuberances extending transversely past one another within said sheet transporting slots;

wherein respective said plural internal transverse sheet corrugating protuberances are alternatingly spaced along said sheet transporting slot and extend towards and transversely past one another from opposing sides of said sheet transporting slot to form a convolute sheet transporting slot which forces the corrugation of said single sheet in said sheet transporting slot; and wherein said protuberances have smoothly arcuate large diameter surfaces, with small surface angles in the direction of sheet insertion, to provide relatively low resistance to the insertion of a sheet into said sheet transporting slots; and wherein said plural internal transverse sheet corrugating protuberances increase the retention of said sheet within said sheet transporting slot without substantially increasing the resistance to lateral movement of said sheet within said sheet transporting slot.

* * * * *